United States Patent [19]

Daines et al.

[11] Patent Number: 4,768,725

[45] Date of Patent: Sep. 6, 1988

[54] APPARATUS FOR WINDING A FILAMENT ONTO A FORMER, HAVING GUIDE STRUCTURE FOR REDUCING FILAMENT BENDING

[75] Inventors: John W. Daines, Bristol; Timothy P. Roberts, Cleavedon; Derek J. Foster, Bristol, all of England

[73] Assignee: Rolls-Royce plc, London, England

[21] Appl. No.: 866,364

[22] Filed: May 23, 1986

[30] Foreign Application Priority Data

Jun. 6, 1985 [GB] United Kingdom ..... 8514335

[51] Int. Cl.[4] ..... B65H 81/02

[52] U.S. Cl. ..... 242/4 BE

[58] Field of Search ..... 242/4 R, 4 B, 4 BE, 242/7.14; 57/10, 13

[56] References Cited

U.S. PATENT DOCUMENTS

| | | | |
|---|---|---|---|
| 1,603,801 | 10/1926 | Potter | 242/4 BE |
| 2,360,960 | 10/1944 | Martindell | 242/7.14 |
| 2,406,397 | 8/1946 | Parkinson | 242/7.14 |
| 2,433,112 | 12/1947 | Goddard | 242/4 B |
| 2,904,271 | 9/1959 | Beusshausen | 242/4 BE |
| 3,183,583 | 5/1965 | Ostermann | 57/13 |
| 3,801,028 | 4/1974 | LaBoda | 242/4 BE |
| 4,637,563 | 1/1987 | Arii et al. | 242/4 B |

FOREIGN PATENT DOCUMENTS

| | | |
|---|---|---|
| 382384 | 10/1923 | Fed. Rep. of Germany . |
| 2001400 | 1/1979 | United Kingdom . |

*Primary Examiner*—Stuart S. Levy
*Assistant Examiner*—Joseph J. Hail, III
*Attorney, Agent, or Firm*—Parkhurst & Oliff

[57] ABSTRACT

An apparatus for winding a filament onto a former includes one or more filament supply bobbins mounted on an annular carrier for rotation about a first axis for receiving a plurality of windings of the filament, and a translation device for moving the former relative to the carrier along a path which passes through the carrier thereby enabling the filament to be wrapped around the former. A guide member guides the filament from a respective bobbin to the former, the guide member defining a radially outward facing cylindrical surface. The apparatus reduces bending of the filament as it is wound onto the former.

5 Claims, 6 Drawing Sheets

Fig. A.
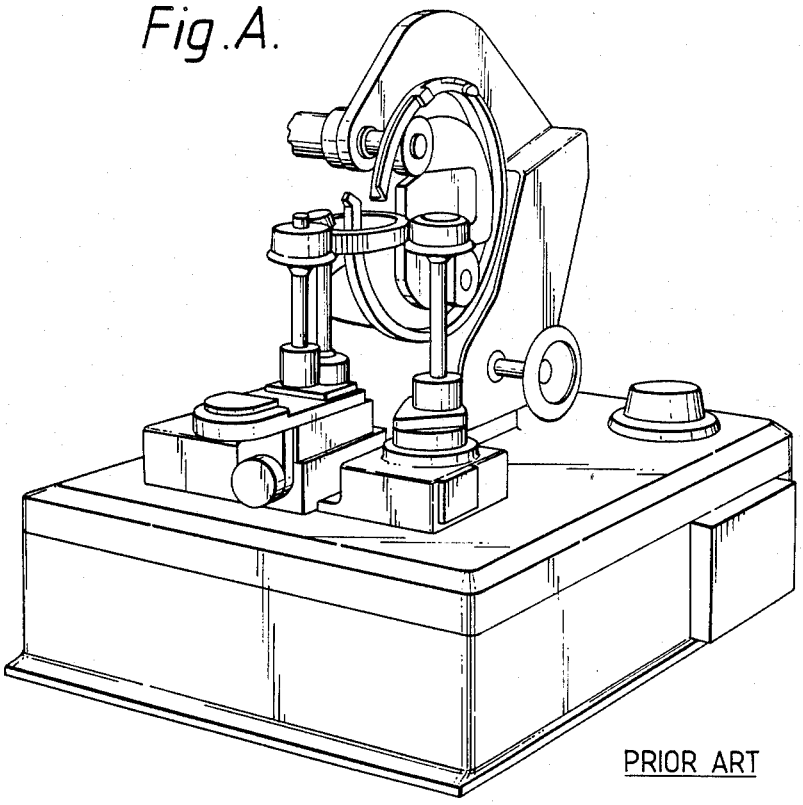
PRIOR ART
Fig. B.
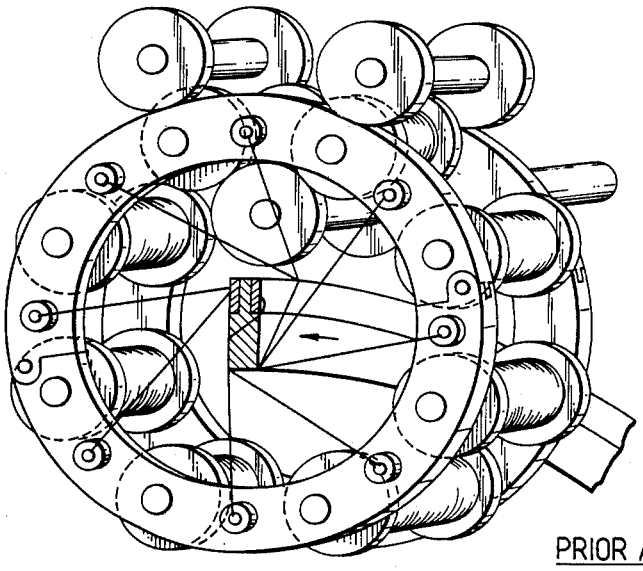
PRIOR ART

APPARATUS FOR WINDING A FILAMENT ONTO A FORMER, HAVING GUIDE STRUCTURE FOR REDUCING FILAMENT BENDING

BACKGROUND OF THE INVENTION

The present invention relates to an apparatus for winding a filament onto a former.

In our UK Pat. No. 2,001,400, there is described an apparatus (shown in FIG. A) suitable for the production of brush seals in which an annular mandrel is mounted for rotation in rollers and carries a pair of annular side plates on its side faces adjacent its radially outer periphery. The mandrel is arranged to pass through an annular filament carrier which is channel-shaped and on which is wound a continuous filament of metallic bristle material. The filament carrier is supported for rotation in a plurality of rollers, one of which is connected to a drive shaft for rotating the carrier, and a similar driving arrangement is used for driving the rollers which support the mandrel. Rotation of the mandrel and the filament carrier causes bristle material to be continuously supplied from the filament carrier, via a slider which tensions the filaments, and wound onto the mandrel to overlie the outer side surfaces of the side plates.

This apparatus whilst producing adequate seals, suffers from a number of disadvantages due to its design. Several filaments of brush material are bunched together on the carrier, resulting in uneven tension, overlaps, and wire breakages. The slider tends to stick and slip during operation which causes uneven tension and breakages. The erratic movement of the slider also results in a lack of angle control. The filaments are passed through tight radii during winding which makes subsequent heat treatment essential to remove any tendency for the filaments to curl up in the finished brush.

The above mentioned patent also describes an alternative winding mechanism which uses multiple filaments for speeding up the winding process (shown in FIG. B). In this embodiment, eight spools of filament material are mounted upon the carrier and each spool feeds a filament of brush material onto the mandrel. The filaments from the spools are passed through holes in one side of the side plates of the spool carrier to ensure that they always emerge in the same plane to avoid variation in the winding angle as the spools unwind.

The spool carrier is hinged at one position and provided with a latch to enable the annular mandrel to pass through the inside thereof.

The alternative winding mechanism overcomes a number of the problems associated with the first described apparatus. However, some problems remain and others are introduced. The filaments are still passed through tight radii which results in subsequent heat treatment being required and/or wire breakages occurring. Further to this, the carrier is considerably more complex and difficult to load with bobbins of filament material.

SUMMARY OF THE INVENTION

An object of the present invention is to provide an apparatus for the production of brushes which reduces, and possibly eliminates, the above mentioned disadvantages.

According to this invention, there is provided an apparatus for winding a filament onto a former, the apparatus comprising one or more filament supply means mounted on an annular carrier for rotation about a first axis, and translation means for moving the former relative to the carrier along a path which passes through the carrier, thereby enabling a filament to be wrapped around the former, the one or more filament supply means comprising a rotatable bobbin for receiving a plurality of windings of a length of the filament, and a guide member over which the filament passes from the bobbin to the former, the guide member defining a radially outward facing cylindrical surface.

BRIEF DESCRIPTION OF THE DRAWING

The present invention will now be more particularly described, by way of example only, with reference to the following drawings, in which.

FIGS. A, and B illustrate the prior art.

DESCRIPTION OF THE PREFERRED EMBODIMENTS

Figure 1:
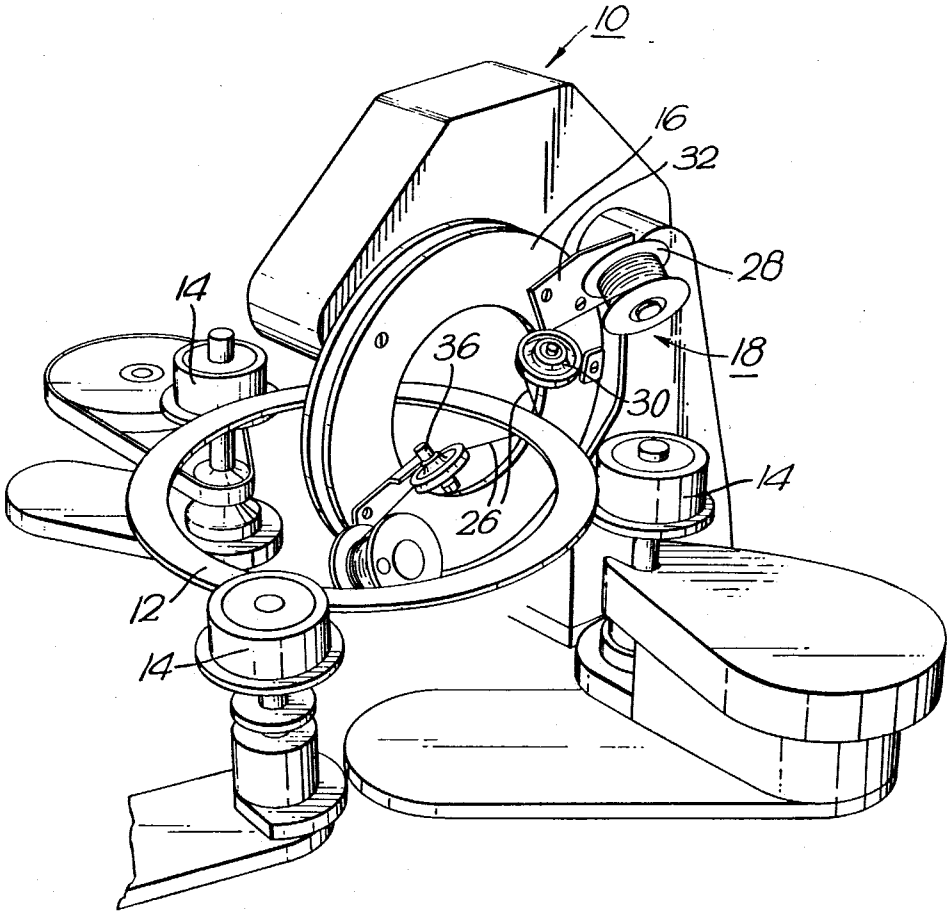
FIG. 1 is a general view of a toroidal winding machine incorporating the present invention.

Referring now to FIG. 1, there is shown a toroidal winding machine (10) which incorporates the present invention. An annular mandrel or former (12) is mounted for rotation in driven rollers (14) and carries a pair of annular side plates (not shown) on its side faces adjacent its radially outer periphery. The mandrel (12) is arranged to pass through an annular filament carrier (16) upon which is mounted one or more filament supply means (18), best seen in FIGS. 2–5. The filament carrier (16) is mounted for rotation in a plurality of rollers (not shown), one or more of which are driven. A hinge (20) and latch (22,24) are provided in the carrier (16) (see FIG. 2) to enable the annular mandrel (12) to pass through the inside thereof.

Rotation of the mandrel (12) and the filament carrier (16) causes a filament of bristle material (26) to be continuously supplied from the supply means (18) and wound onto the mandrel (12) to overlie the outer surface thereof.

Figure 2:
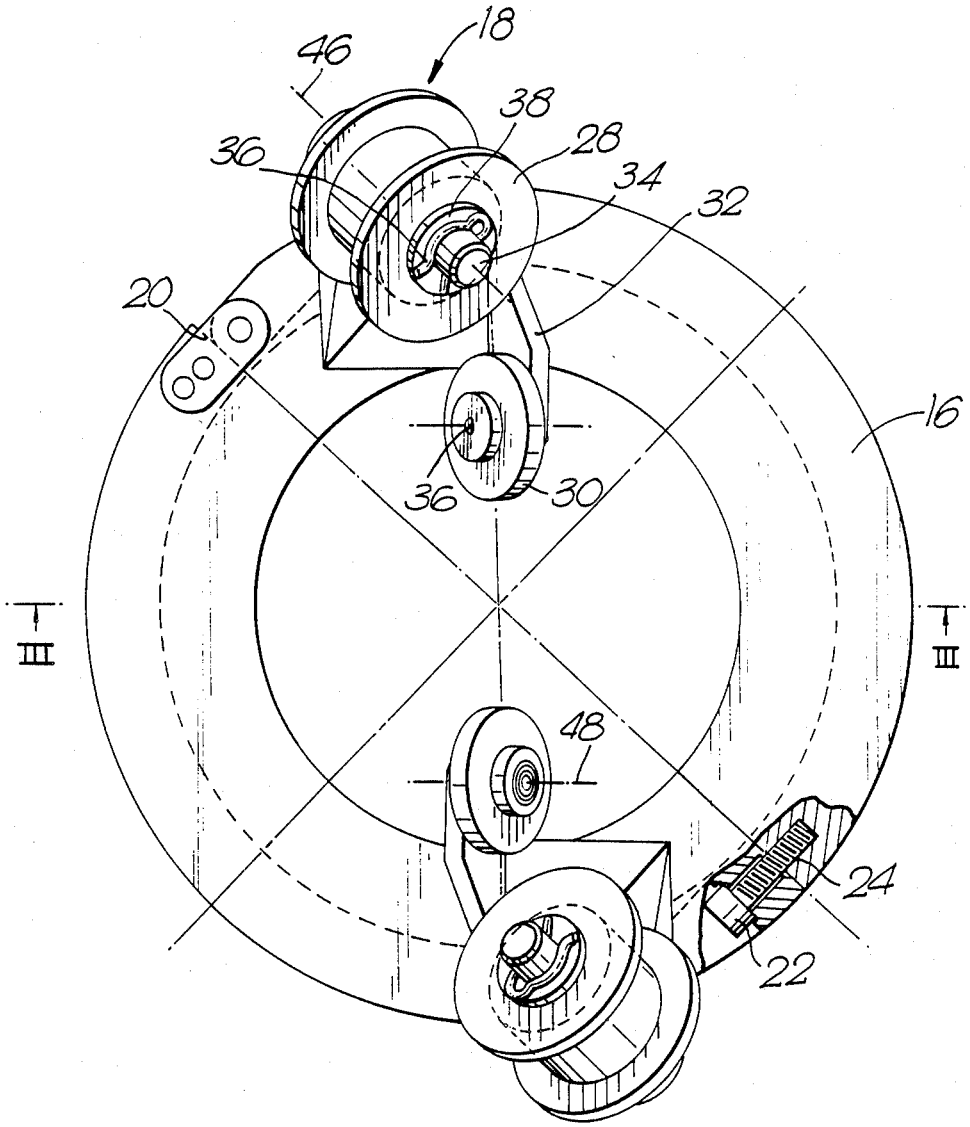
FIG. 2 is a more detailed view of the present invention.
Figure 3:
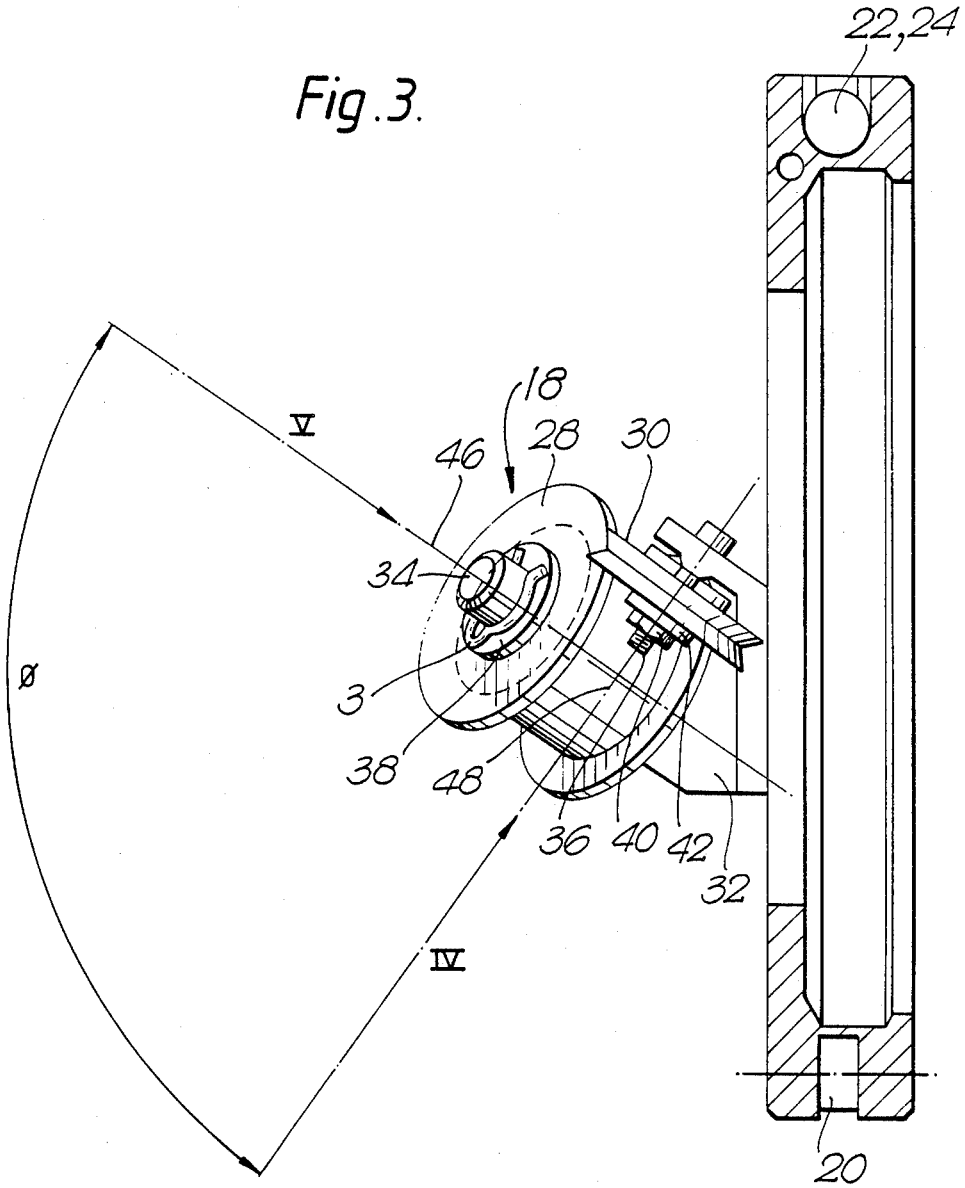
FIG. 3 is a cross-sectional view in the direction of arrows III—III in FIG. 2.
Figure 4:
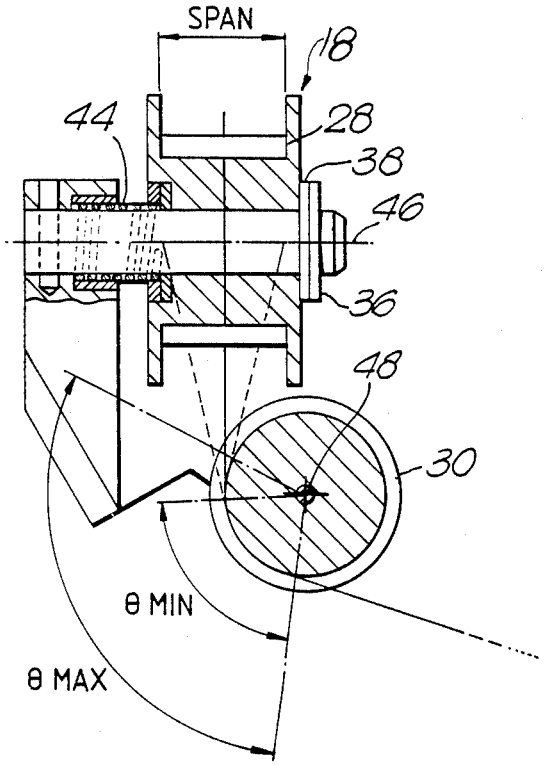
FIG. 4 is a cross sectional view through the pulley in the direction of arrow IV in FIG. 3.

Turning now to FIGS. 2 and 3, the filament supply means (18) comprises a bobbin (28) upon which is wound a supply of filament material (26), a pulley (30) around which is lapped the filament material (26), and a bracket (32) having two spindles (34) and (36) upon which the bobbin (28) and pulley (30) respectively are mounted for rotation. A circlip (36) and a friction washer (38) are provided to retain the bobbin (28) on the spindle (34), whilst a nut (40) and washer (42) arrangement (best shown in FIG. 5) are used to retain the pulley (30) on the spindel (36). It will be appreciated, however, that any conventional retaining means may be employed for this task. In FIG. 4, there is shown a spring (44) which urges the bobbin (28) into contact with friction washer (38) such that rotation of the bobbin (28) is at least partially resisted and the filament material is tensioned as it is supplied to the mandrel.

Figure 5:
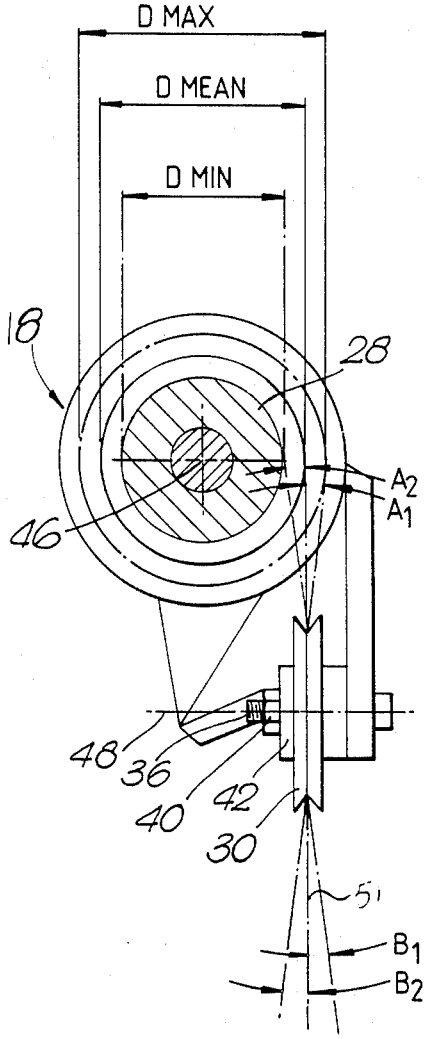
FIG. 5 is a plan view of the bobbin and pulley in the direction of arrow V in FIG. 3.

Referring now to FIGS. 4 and 5 in particular, the positional relationship between the bobbin (28) and the pulley (30) is clearly illustrated. The axis of rotation of the bobbin (46) and the axis of rotation of the pulley (48) are arranged to be orthogonal to, but spaced from, each other. The pulley is positioned such that its main plane of rotation 51 is at a tangent to the mean diameter ($D_{MEAN}$) of the filament material (26) wound around the bobbin (28), and for convenience its outer diameter is positioned such that it is at the mid span of the bobbin (28).

In operation, a strand of filament material (26) is taken from the bobbin (28), passed around the pulley (30) (through an angle of lap $\theta$) and supplied to the mandrel (12). As the filament material (26) unwinds from the bobbin (28), it runs from one end of the bobbin (28) to the other such that the angle of lap $\theta$ changes from $\theta$ max to $\theta$ min as shown in FIG. 4. It will be appreciated, however, that the pulley (30) may be located at any position across the span of the bobbin (28) without altering the magnitude of change in the angle of lap $\theta$. As the diameter of the filament material (26) wound on the bobbin (28) reduces from $D_{MAX}$ to $D_{MIN}$, it will be appreciated that the angle at which the pulley (30) receives the filament material (26) from the bobbin (28) measured relative to the main plane of rotation (51) of the pulley (30) will change from ($A_1$) to ($A_2$). Preferably, the change in the pulley receiving angle ($A_1$) which occurs due to the reduction in diameter of filament material on the bobbin (28) between $D_{MAX}$ and $D_{MEAN}$ is substantially the same as the change in the pulley receiving angle ($A_2$) which occurs due to the reduction in diameter of the filament material on the bobbin (28) between $D_{MEAN}$ and $D_{MIN}$.

Figure 6:
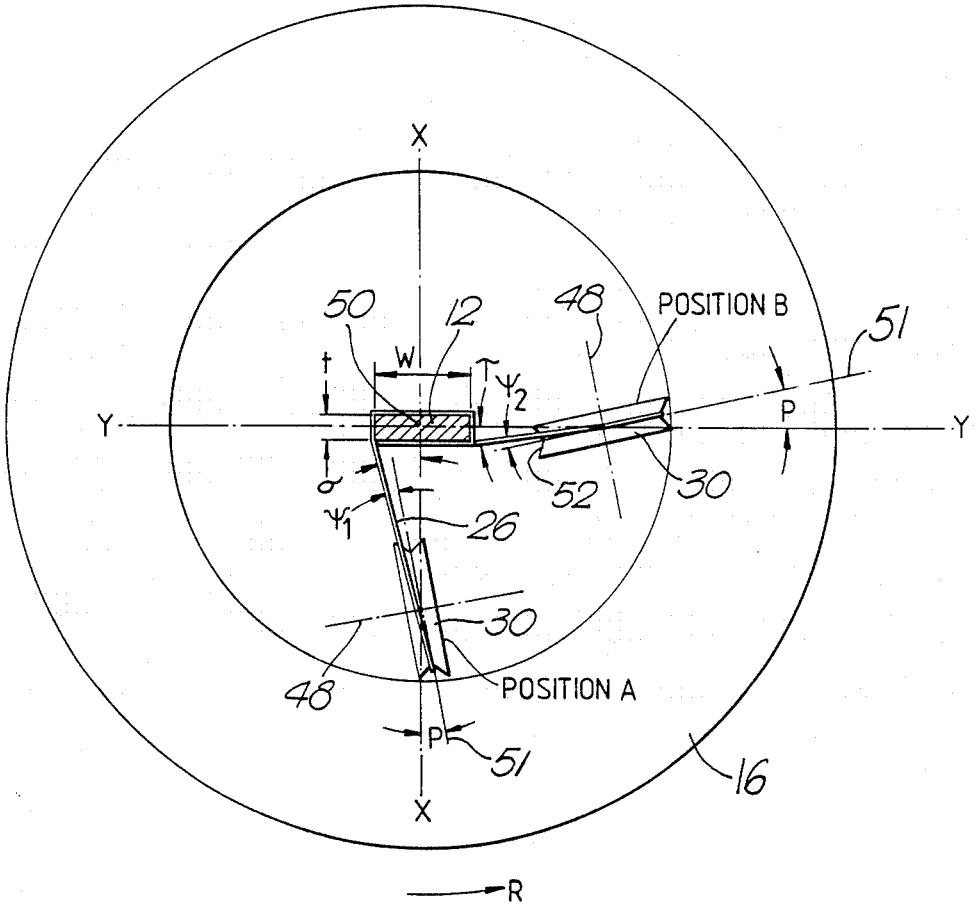
FIG. 6 illustrates the angular relationship between the pulley and the mandrel.

The positional relationship between the pulley (30) and the mandrel (12) is best seen in FIG. 6. The pulley (30) is positioned such that when its geometric centre coincides with either of the cross-sectional neutral axes of the mandrel (X,X, or Y,Y), the pulley (30) is angled relative to said neutral axis by an amount $\rho$. The axis Y—Y is in the same plane as the main plain of rotation of the mandrel and passes through the centroid of area of the mandrel (50), whilst the axis X—X is perpendicular to axis Y—Y and passes through the centroid of area which is a point half way between the inside diameter and the outside diameter of the mandrel (12) as it passes through the carrier (16).

As the carrier (16) rotates in the direction of arrow R from position A, where its geometric centre is coincident with the axis X—X, to position B, where its geometric centre is coincident with the axis Y—Y, the angle at which the filament (26) leaves the pulley (30), measured relative to the nearest neutral axis, varies between $\delta$ and $\tau$. The angle $\delta$ is greater than $\tau$ for a mandrel (12) having a width W greater than its thickness t as shown in FIG. 6. It will be appreciated that, in order to reduce the angle at which the filament leaves the pulley to a minimum, the angle at which the pulley is positioned relative to the nearest neutral axis should be half way between $\delta$ and $\tau$. If the pulley is so angled, the angle at which the filament leaves the pulley in position A (angle $\psi_1$), measured relative to the main plane of rotation of the pulley, is equal but opposite to the angle ($\psi_2$) at which the filament leaves the pulley relative to the main plane of rotation of the pulley in position B. In such an arrangement, the filament material will progress from one side of the pulley mouth (52) to the other, as the pulley moves from position A to position B. Preferably, the pulley mouth (52) is shaped to accommodate this movement without the wire snagging on its surface.

An example of a filament material (26) which may be used in the production of brush seals which are intended for high temperature applications is a Nickel alloy sold under the trade name of HAYNES 25. It has been found that for a filament having a diameter of 0.0028" the angle at which the filament (26) approaches the pulley (30) or leaves the pulley (30) ($A_1$, $A_2$ or $B_1$, $B_2$ respectively) FIG. 5 may be as much as 44° and the bobbin (28) and pulley (30) diameters as little as 25.4 mm (1") without the filament material (26) requiring subsequent heat treatment to remove any tendency to curl up in the finished seal. It will be appreciated however that these angles and diameters will vary with the properties of the filament material (26).

We claim:

1. An apparatus for winding a filament onto an annular former having a first neutral axis (x—x), a second neutral axis (y—y), a main plane of rotation and a centroid of area, the apparatus comprising:

means for rotating the former;

an annular carrier, having an axis of rotation and a main plate of rotation which is orthogonal to the main plane of rotation of the former;

means for rotating the carrier;

filament supply means comprising at least one rotatable bobbin for receiving a plurality of windings of a length of the filament and being mounted on the carrier for rotation about the axis of rotation of the carrier;

translation means for moving the former relative to the carrier along a path which passes through the carrier; and at least one rotatably mounted pulley over which the filament is passed from the bobbin to the former, said pulley having a main plane of rotation, a geometric centre and an axis of rotation, the axis of rotation of said pulley being angled relative to the main plane of rotation of the carrier and the axis of rotation of the carrier, and being orthogonal to, but spaced from, an axis of rotation of the bobbin.

2. An apparatus according to claim 1, wherein the annular former has an inner circumferential side and an outer circumferential side, the centroid of area of the former is half way between said inner and outer circumferential sides, the second neutral axis (y—y) is in the same plane as the main plane of rotation of the former and passes through the centroid of area of the former, and the first neutral axis (x—x) is perpendicular to the second neutral axis (y—y) and also passes through the centroid of area of the former.

3. An apparatus according to claim 1, wherein the main plane of rotation of the pulley is tangential to a predetermined diameter of the filament wound on the bobbin.

4. An apparatus according to claim 3, wherein the predetermined diameter is halfway between a maximum diameter ($D_{max}$) of the filament wound on the bobbin and a minimum diameter ($D_{min}$) of the filament wound on the bobbin.

5. An apparatus according to claim 1, wherein of a filament is deflected to either side of the pulley's main plane of rotation as it is laid down onto the former, and wherein the main plane of rotation of the pulley is angled out of the main plane of rotation of the former by an amount equal to half the total included angle of deflection of said filament.

* * * * *